US005100135A

United States Patent [19]

Bourgeois

[11] Patent Number: 5,100,135

[45] Date of Patent: Mar. 31, 1992

[54] FOOTBALL KICKING TEE SUPPORT

[76] Inventor: Vernon S. Bourgeois, 248 Bluebird Dr., Slidell, La. 70458

[21] Appl. No.: 745,550

[22] Filed: Aug. 15, 1991

[51] Int. Cl.[5] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| 1,608,361 | 11/1926 | Boettcher | 273/55 B |
| 3,087,726 | 4/1963 | Pogue | 273/55 B |
| 3,309,087 | 3/1967 | Collity | 273/55 B |
| 3,481,602 | 12/1969 | Tatter | 273/55 B |
| 3,516,667 | 6/1970 | Williams | 273/55 B |
| 4,049,267 | 9/1977 | Forrest | 273/55 B |
| 4,807,880 | 2/1989 | Deal | 273/55 B |

*Primary Examiner*—William H. Grieb
*Attorney, Agent, or Firm*—Henderson & Sturm

[57] ABSTRACT

A football kicking tee having a pair of hinged gates attached to the rear portion of the tee. The gates are movable between a closed position and an open position by contact of the kicker's foot as it approaches the football. Each gate carries an upwardly and outwardly extending holder having a contoured arm disposed to support the upper sidewall section of the football when the gates are in the closed position. When the gates are pivoted open by the kicker's foot, the attached holders move away from the sidewall of the football to provide unobstructed access.

10 Claims, 3 Drawing Sheets

FOOTBALL KICKING TEE SUPPORT

TECHNICAL FIELD

This invention relates to a football kicking tee, and more particularly to a tee that provides temporary support to an upper sidewall section of the football.

BACKGROUND ART

Football is a popular outdoor sport played in all types of weather. Under windy conditions the football is frequently blown from the kick-off tee while the special team's kicker is approaching or preparing to approach the ball. If windy conditions persist, one of the special team players must leave his assigned position to hold the football. In professional and college football where each player on the special team has a specific assignment, this prevents the player from performing his assignment as originally planned.

Those concerned with these and other problems recognize the need for an improved football kicking tee.

DISCLOSURE OF THE INVENTION

The present invention provides a football kicking tee having a pair of hinged gates attached to the rear portion of the tee. The gates are movable between a closed position and an open position by contact of the kicker's foot as it approaches the football. Each gate carries an upwardly and outwardly extending holder having a contoured arm disposed to support the upper sidewall section of the football when the gates are in the closed position. When the gates are pivoted open by the kicker's foot, the attached holders move away from the sidewall of the football to provide unobstructed access.

An object of the present invention is the provision of an improved football kicking tee.

Another object is to provide a football kicking tee for use in windy playing conditions.

A further object of the invention is the provision of a football kicking tee that is easy to use.

Still another object is to provide a football kicking tee that is inexpensive to manufacture.

A still further object of the present invention is the provision of a football kicking tee adapted for use at all levels of competition.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
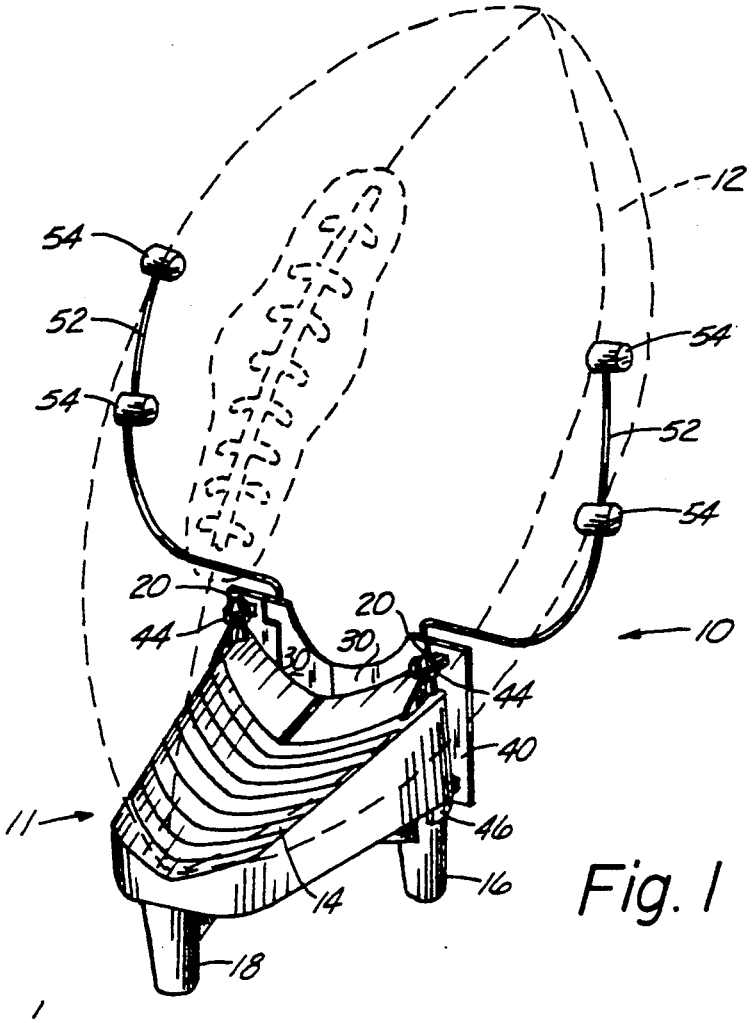
FIG. 1 is a front perspective view of the football kicking tee of the present invention with a dashed line showing of a football positioned on the tee.
Figure 2:
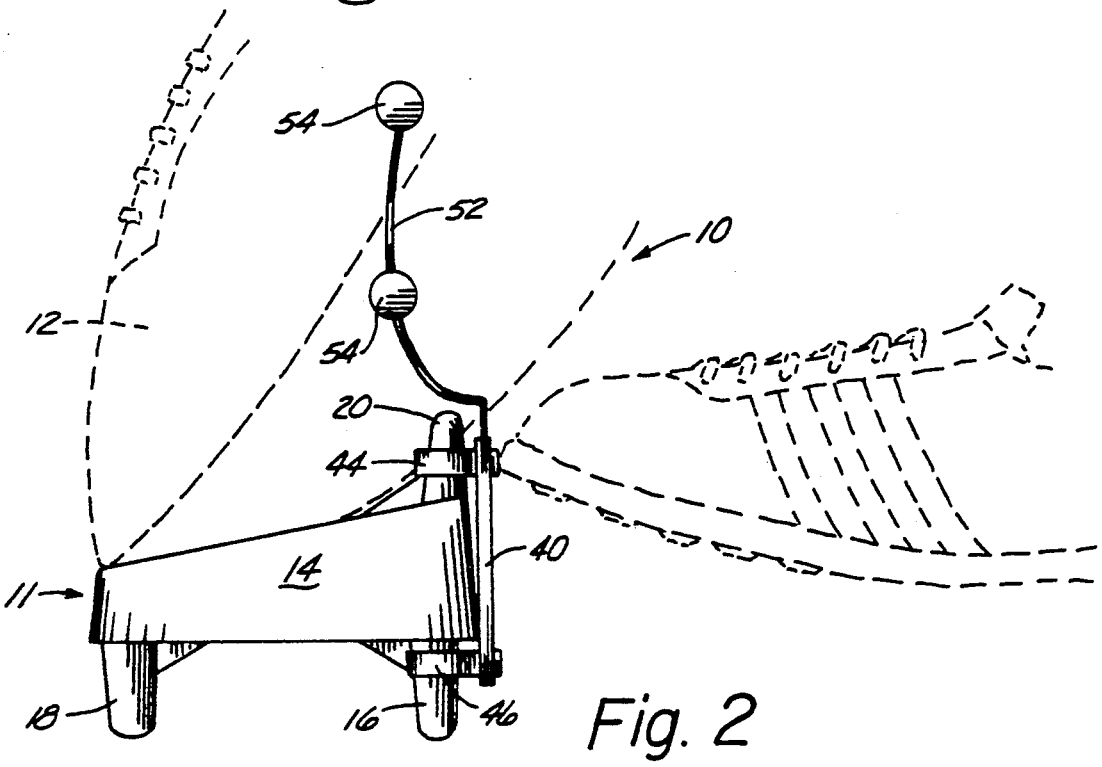
FIG. 2 is a side elevational view of the tee with a dashed line showing of the football on the tee and the kicker's foot approaching the football.
Figure 3:
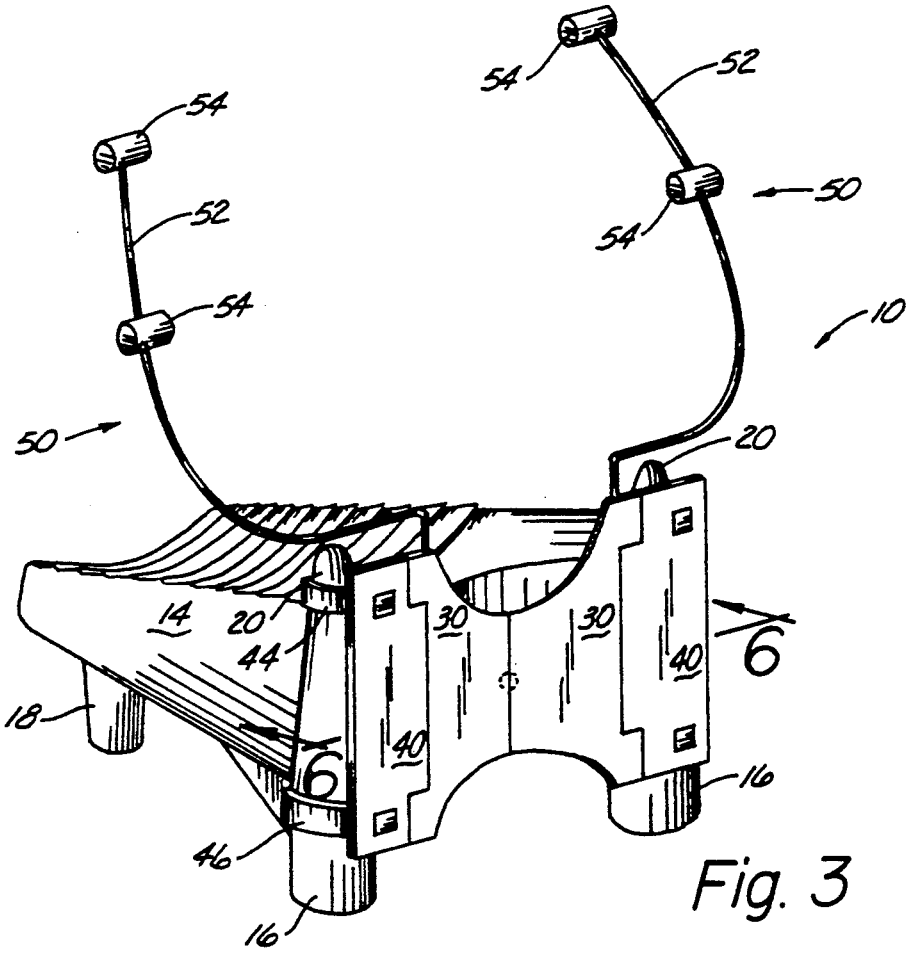
FIG. 3 is a rear perspective view of the tee showing the pair of movable gates and holders attached to the rear portion of the tee.
Figure 4:
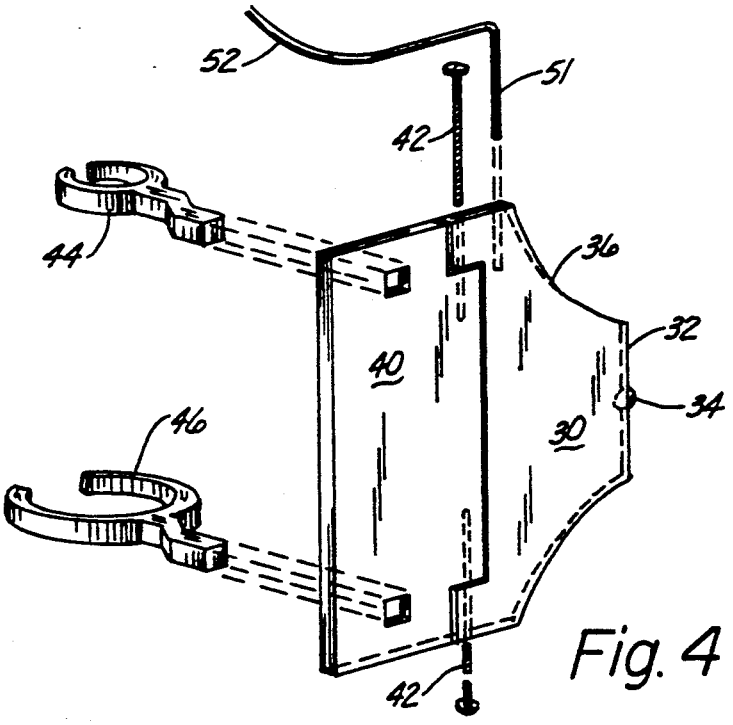
FIG. 4 is an exploded perspective view of one of the gates illustrating the attachment of the bracket and the holder to the gate.

Referring now to the drawings, wherein like reference numerals designate identical or corresponding parts throughout the several view, FIG. 1 shows the football kicking tee (10) of the present invention with a football (12) positioned on the tee (10). As best shown in FIGS. 1–3, the base (11) of the tee (10) is of a conventional design and includes a bed (14) supported above the playing surface by a pair of rear legs (16) and a front leg (18). The rear portion of the base (11) carries a pair of spaced upwardly extending supports (20) disposed directly above the rear legs (16).

Figure 5:
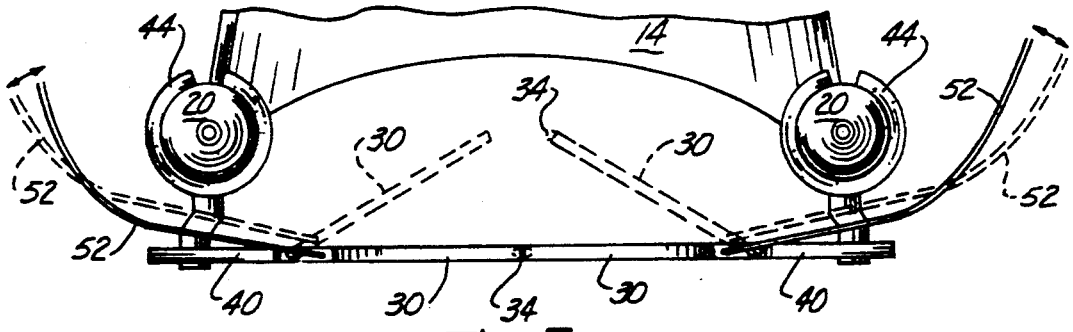
FIG. 5 is an enlarged partial top plan view showing the gates in the closed position with a dashed line illustration of the gates in the open position.
Figure 6:
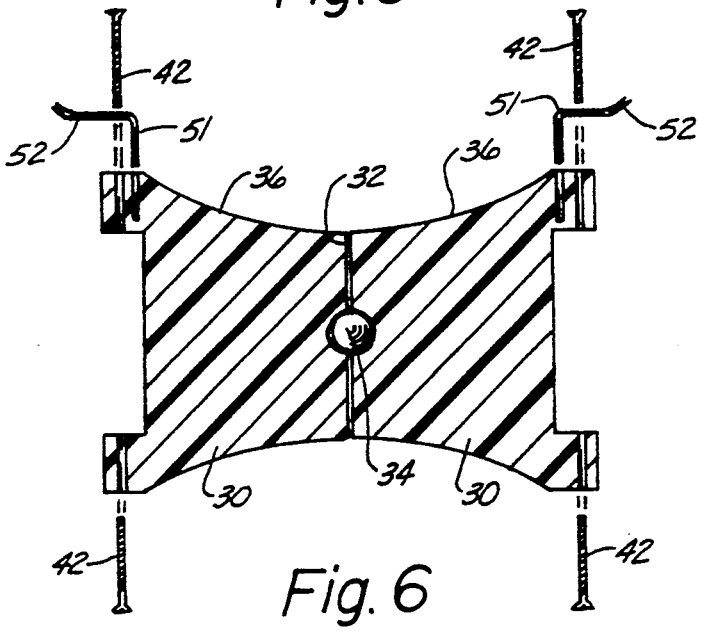
FIG. 6 is a sectional view taken along line 6—6 of FIG. 3.

As most clearly shown in FIGS. 3–6, a pair of gates (30) is pivotally attached to the rear portion of the base (11) and is movable between a closed position and an open position (FIG. 5). Each gate (30) includes a free end (32) which carries a portion of a roller bearing catch (34) to hold the adjacent free ends (32) together when the gates (30) are in the closed position. The upper edge (36) of each gate (30) is positioned below the upwardly extending supports (20) at about the elevation of the rear of the bed (14).

Each gate (30) is pivotally attached to a bracket (40) by pivot pins (42). Each bracket (40) includes an upper loop (44) that extends over and around an upwardly extending support (20), and a lower loop (46) that extends around the corresponding rear leg (16).

A holder (50) is adjustably pivotally attached to each gate (30) by friction fit engagement of the lower end (51) of the holder (50) in a cavity formed in the gate (30). Each holder (50) includes a metal wire contoured arm (52) that extends upwardly and outwardly from each gate (30). A pair of spaced pads (54) are attached to each arm (52) and extend inwardly to contact and support the upper sidewall section of a football (12).

In use, the brackets (40) are attached to a conventional base (11) by slipping the upper loops (44) over the upwardly extending supports (20) and clipping the lower loops (46) around the corresponding rear legs (16). The football (12) is then positioned so that one end rests on the tee bed (14) and the lower sidewall section is supported by the upwardly extending supports (20). The gates (30) are then moved to the closed position and held by the catch (34).

As the gates (30) are moved to the closed position, the attached holders (50) are moved toward the football (12) so that the pads (54) contact and support the upper sidewall sections of the football (12).

Figure 7:
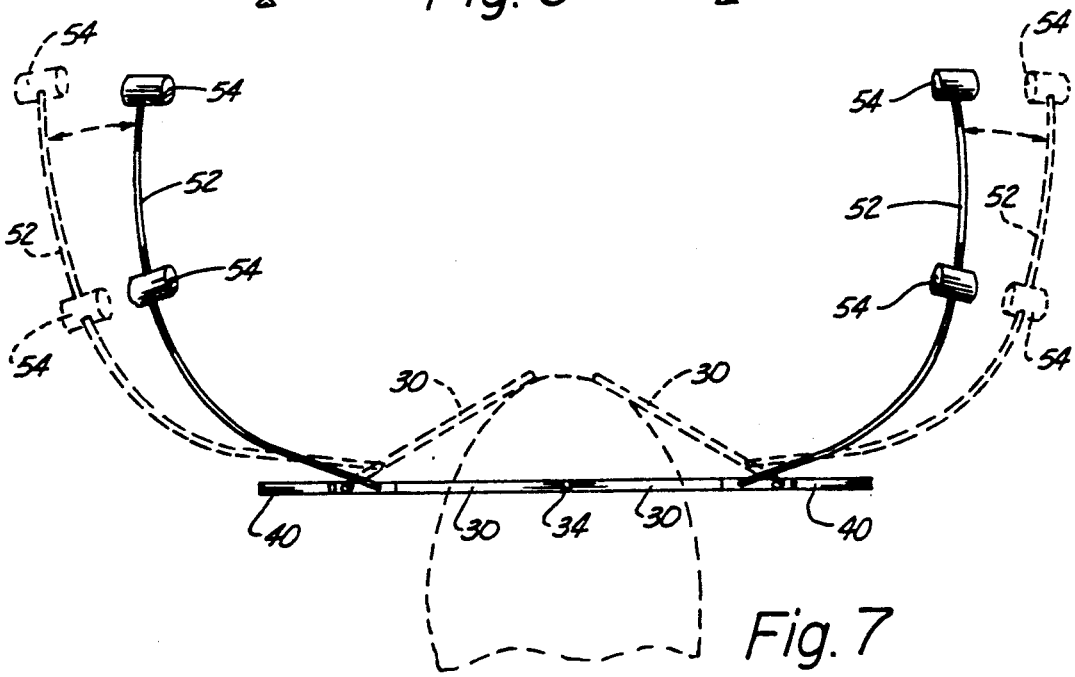
FIG. 7 is an enlarged partial top plan view showing the gates in the closed position with a dashed line illustration of the gates being moved to the open position by the approaching toe of the kicker.

As the kicker's foot approaches the football (12), the toe brushes the gates (30) and swings them to the open position (FIG. 7). As the gates (30) open, the holders (50) move away from the upper sidewall of the football (12) allowing the football (12) to leave the tee (10) as the kicker's foot propels the football unobstructed.

Thus it can be seen that at least all of the stated objectives have been achieved.

Obviously many modifications and variations of the present invention are possible in light of the above teachings. It is therefore to be understood that, within the scope of the appended claims, the invention may be practiced otherwise than as specifically described.

I claim:

1. In a football kicking tee including a rear portion having a pair of spaced upwardly extending supports disposed to contact and support spaced lower sidewall sections of a football and a forwardly extending bed disposed to contact and support an end of the football, the improvement comprising:

a pair of hinged gates movable between a closed position and an open position, each gate being pivotally attached to the rear portion of the tee and having a free end, the free ends of the pair of gates being disposed adjacent to each other when the gates are in the closed position; and a holder attached to and extending upwardly and outwardly from each gage, each holder including a contoured arm disposed to contact and support an upper sidewall section of the football when the associated gate is in the closed position, and disposed to be spaced outwardly from the upper sidewall section when the gate is in the open position.

2. The kicking tee of claim 1 wherein each gate includes an upper edge disposed at an elevation below the upwardly extending tee supports.

3. The kicking tee of claim 2 wherein the upper edge of each gate is disposed at approximately the same elevation as the rear of the tee bed.

4. The kicking tee of claim 1 further including latch means for holding the gates in the closed position.

5. The kicking tee of claim 4 wherein the latch means includes a roller bearing catch attached to the free ends of the gates.

6. The kicking tee of claim 1 wherein the tee includes a pair of spaced downwardly extending legs disposed below the upwardly extending tee supports, and wherein each gate is pivotally attached to a bracket, each bracket including an upper loop disposed to extend over and around one tee support and a lower loop disposed to extend around the corresponding leg.

7. The kicking tee of claim 1 wherein each holder is adjustably pivotally attached to the corresponding gate whereby the position of the arm may be selectively adjusted to be positioned adjacent the football when the gates are in the closed position.

8. The kicking tee of claim 7 wherein each arm includes a pair of pads attached to the arm in spaced relationship such that the pads are disposed to contact and support upper sidewall sections of the football when the gates are in the closed position.

9. The kicking tee of claim 8 wherein the pads extend inwardly from the arms toward the sidewall of the football.

10. The kicking tee of claim 9 wherein the arms are formed from a metal wire.

* * * * *